United States Patent [19]

Berry

[11] 4,311,519

[45] Jan. 19, 1982

[54] MELTING FURNACE FOR GRANULATED METAL

[75] Inventor: Milton E. Berry, Carrollton, Ga.

[73] Assignee: Southwire Company, Carrollton, Ga.

[21] Appl. No.: 107,462

[22] Filed: Dec. 26, 1979

[51] Int. Cl.[3] ..... C22B 15/00; F27B 1/02

[52] U.S. Cl. ..... 75/72; 75/65 R; 266/236; 266/900

[58] Field of Search ..... 266/200, 236, 900, 901; 75/65, 43, 44 R, 44 S, 76, 72

[56] References Cited

U.S. PATENT DOCUMENTS

| | | | |
|---|---|---|---|
| 1,713,543 | 5/1929 | Machlet | 266/900 |
| 3,715,203 | 2/1973 | DeBie | 75/76 |
| 3,788,623 | 1/1974 | Vogel | 266/236 |
| 4,200,265 | 4/1980 | Berndt et al. | 266/901 |

*Primary Examiner*—M. J. Andrews

*Attorney, Agent, or Firm*—Herbert M. Hanegan; Stanley L. Tate; Robert Steven Linne

[57] ABSTRACT

Disclosed is a multiple chamber vertical shaft furnace for melting granulated metal. Granulated scrap metal, high-grade crystalline ore or a combination thereof is preheated and sintered into a coherent columnar mass by the present invention. It is then melted in an enlarged melting chamber by multiple burners located in the walls of the furnace which direct heat tangent to the coherent columnar mass in a tubular heating space between the outer surface of the coherent columnar mass and the inner surface of the furnace walls, and flows out of the present invention through a tapping outlet for further processing.

24 Claims, 2 Drawing Figures

MELTING FURNACE FOR GRANULATED METAL

BACKGROUND OF THE INVENTION

The present invention relates generally to metal deforming and specifically to an apparatus and a method for melting granulated metal and/or high-grade crystalline ore.

The present invention has evolved because of the environmental and economic rewards achieved by recycling metal, particularly metals which can be used as conductors in the fabrication of wire and cable that is already in the form of wire, cable or electronic apparatus. Scrap such as scrap wire, scrap cable and scrap electronic apparatus is in demand because of its relative purity.

Metal has been recovered from scrap insulated wire and cable by various insulation stripping and breaking methods disclosed in U.S. Pat. Nos. 3,309,947, 3,724,189, 3,858,776, 3,936,922, 3,977,277 and 4,083,096. U.S. Pat. No. 3,975,208 discloses a method of selectively recovering vinyl halide insulation and metal from scrap insulated wire and cable by the use of chemical solvent. These methods of metal recovery are inflexible because each method can recover metal from limited types of cable and wire. For instance, insulation stripping or breaking of short irregular pieces of scrap wire and cable is not economically feasible and the chemical solvent method is limited to cable and wire with a specific type of insulation. This inflexibility combined with an increasing variety of scrap wire and cable has forced many portions of the industry to chop or granulate the scrap and to separate various sizes, lengths and compositions of the chopped scrap into particles of insulation and particles of metal, by a mechanical separation process thereby producing a particulate feed material of substantially high purity.

Once isolated, metal granules or particles must be melted and refined for recycling into new products. Granulated metal recovered by the granulator process and other types of granulated metal such as shavings, borings, chips and turnings as well as high-grade crystalline ore are normally melted in reverberatory smelting furnaces such as those disclosed in U.S. Pat. Nos. 2,436,124, 3,664,828 and 3,614,079 because of processing difficulties which were encountered when such feed material was processed in vertical shaft-type furnaces. Thus, until the present invention, the options for use in melting granulated metal were restricted to either high energy consuming reverberatory furnaces or mixing very small amounts of granulated metal with large metal pieces in a conventional vertical shaft furnace.

Vertical shaft melting and refining furnaces are well known in the metal melting art. One of the most severe problems experienced with the melting of granulated scrap in prior art shaft furnaces is the formation of a cold state semi-solid mass of metal on the hearth which clogs the tap hole and blocks the burners. In a shaft furnace, the charge must progress down the shaft at a rate slow enough to allow the metal to melt and be carried away through the tap hole because metal settling through the shaft too rapidly will not melt but will instead reach the hearth in the cold state and form a semi-solid mass on the hearth with the unwanted results described above. U.S. Pat. No. 2,283,163 discloses a vertical shaft furnace for melting metal scrap which has an enlarged lower portion for collecting excess heat for independent transfer to other areas of the furnace and where the actual melting of the scrap metal takes place. U.S. Pat. No. 2,283,163 further teaches that during preheating of the scrap charge in the shaft of the furnace, care must be taken to prevent the charge metal from sticking together to prevent clogging of the furnace shaft which the inventor of U.S. Pat. No. 2,283,163 says will happen if substantial quantities of coke or ore are not included in the charge. Controlled combustion in a gas tight vertical shaft furnace to eliminate unwanted oxygen is disclosed in U.S. Pat. No. 3,199,977. Other vertical shaft furnaces are disclosed in U.S. Pat. Nos. 3,715,203 and 3,788,623; but like the furnace of U.S. Pat. No. 2,283,163, none of these furnaces can melt large amounts of granulated scrap metal or high-grade crystalline ore which has not been mixed with other elements such as coke. The present invention solves this problem by providing a vertical shaft melting furnace capable of melting scrap charges containing substantial quantities of copper fines as small as 300 without the intentional blending of fluxes or fuels in such charges as well as charges consisting entirely of nugget sized copper particles and mixtures thereof.

SUMMARY OF THE INVENTION

The present invention is a novel multiple chamber vertical shaft furnace for melting granulated metal and/or high-grade crystalline ore without becoming clogged. Granulated metal scrap, high-grade crystalline ore or a combination thereof is charged into a preheat chamber in the top of the furnace where the cold charge is heated by convection. It must be noted that if the particle size of the feed material is too small, as with "clear copper" (a copper precipitate produced by a hydrometallurgical process,) the charge metal will be carried out of the furnace through the top of the shaft with the flue gases. Therefore, it shold be pointed out that the minimum particle size of the charge granules is limited to particles which have enough mass to allow gravity to overcome the updraft created in the shaft by the flue gases.

Below the preheat chamber is a sintering chamber where the preheated metal granules are sintered by heating to a temperature slightly below the melting point of the charge metal by a plurality of controlled burners located in the refractory walls of the furnace which direct heat radially inward. While in the sintering chamber the granulated metal mass does not melt because of the compactness of the charge and the high surface area to volume ratio of the charge but, instead, forms a coherent columnar mass with a temperature just below the melting temperature of the metal. The coherent sintered mass will not stick to the walls of the furnace shaft because the walls are refractory lined and because as the granulated metal compacts into a coherent columnar mass, the mass should shrink slightly away from the shaft walls as the mass sinters together, eliminating voids.

Below the sintering chamber is a melting chamber which is larger in diameter and shorter in height than the sintering chamber. Because the metal charge has been sintered into a columnar mass taller than the height of the melting chamber prior to entering the diametrically enlarged melting chamber, the columnar mass of metal formed in the sintering chamber is compelled to remain in the center of the melting chamber as it descends through the shaft thereby effectively creating a tubular melting space around the columnar mass. Multiple symmetrically spaced burners in and around the refractory wall of the melting chamber direct heat into the tubular melting space tangent to the sintered columnar mass in such a manner that flame swirls from a point directly opposite a tap hole in the bottom of the melting chamber symmetrically around both sides of the sintered column of metal toward the tap hole. This tangent swirling flame melts the sintered column of metal from its outer surfaces toward its center and as the column melts, the melted portion is replaced by the continuously descending sintered charge. The molten metal flows down the hearth (preferably a multiple level hearth of the type disclosed in U.S. patent application Ser. No. 088,263 filed on Oct. 25, 1979 by the assignee of the present invention to promote melting of the bottom surface of the column while providing continued support for the sintered column) in the melting chamber and out of the furnace through the tap hole.

Thus an important object of the present invention is to provide an improved vertical shaft furnace for melting granulated metal recoverd from recycled scrap by granulators, granulated metal recovered from new scrap sources such as machining operations, as well as high-grade crystalline ore, copper precipitates from hydrometallurgical processes, standard large piece metal charge or any combination thereof without becoming clogged.

DESCRIPTION OF THE PREFERRED EMBODIMENT

Figure 1:
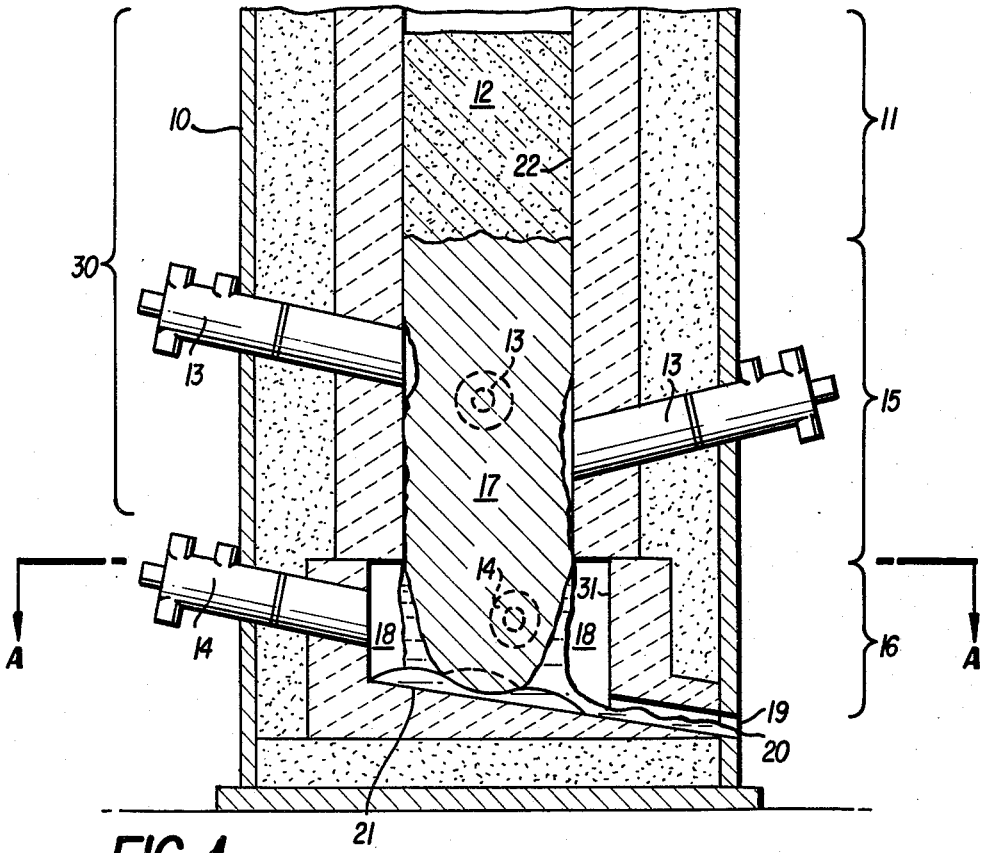
FIG. 1 is a sectional elevation of the preferred embodiment of the present invention.
Figure 2:
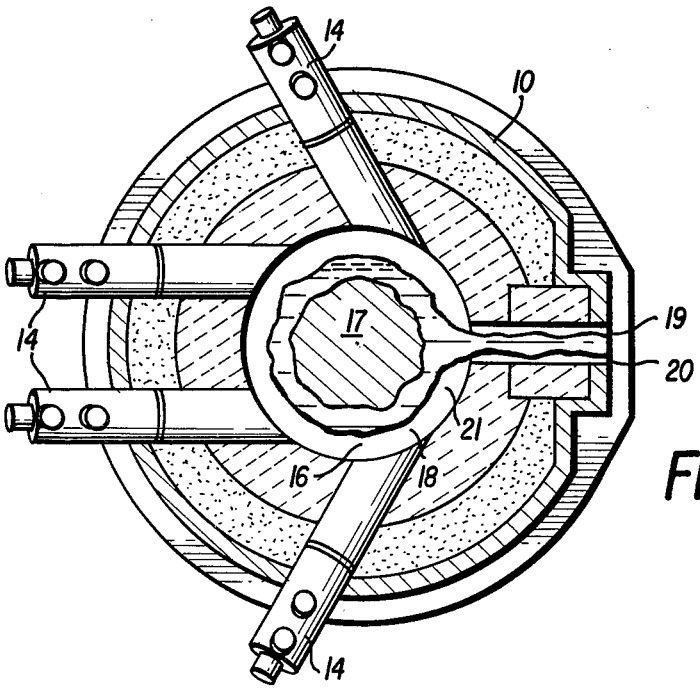
FIG. 2 is a top view of the enlarged melting chamber taken along line A—A of FIG. 1.

While the specification concludes with claims particularly pointing out and distinctly claiming the subject matter which is regarded as the invention, it is believed that the invention, objects, features and advantages thereof will be better understood from the following description taken in connection with the accompanying drawings in which like parts are given like reference numerals.

Granulated metal is gravity-charged into the top of the present invention by a charging device which is not shown. At least ten percent of the granulated metal will pass through a 300 mesh screen. As seen in FIG. 1, furnace 10 is divided into a barrel 30 and melting chamber 16, the uppermost portion of the barrel 30 is a preheat chamber 11 where cold charge 12 is heated by convection from burners 13 and 14 located in sintering chamber 15 and melting chamber 16. The center portion of the furnace is a sintering chamber 15 where the temperature of descending preheated charge 12 is raised in a controlled manner to just below the melting temperature of the charge metal by convection from melting chamber burners 14 and by direct application of heat from sintering chamber burners 13 to form a sintered columnar mass of charge 17. Due to the compactness of the granulated metal charge 12, its high surface area to volume ratio and the controlled manner in which the sintering chamber burners 13 are operated, the charge is not melted, but is instead sintered, as the charge 12 is heated to a temperature just below the liquidus temperature of the charge metal thereby causing the charge 12 to form a coherent columnar mass 17 which is melted in melting chamber 16. The columnar mass 17 blocks the passage of charge granules 12 through the shaft and into the bottom of the furnace thereby preventing the uncontrolled formation of a semi-solid mass of unmelted metal on the hearth 21. One of the most severe problems experienced with the melting of granulated scrap in prior art shaft furnaces was the uncontrolled formation of a cold state semi-solid mass of metal on the hearth which clogged the tap hole and blocked the burners; but furnace 10 is provided with melting chamber 16 which is adapted to receive the mass of charge 17 in a controlled manner and melt the same while keeping the tap hole 19 clear and burners 14 unblocked. During operation of furnace 10, the charge will not stick to the inner walls 22 of the furnace 10 because the inner walls 22 are refractory lined and because as the charge compacts into a coherent columnar mass 17, and shrinks slightly away from inner walls 22 as the mass sinters together, eliminating voids.

Below the sintering chamber 15 is the melting chamber 16 with a longer diameter and shorter height than the sintering chamber 15 immediately above it. Generally the barrel 30 should have a diameter of from about 2.5 to about 6.0 feet with the preferred diameter being about 4.5 feet. The diameter of melting chamber 16 should be from about 1.2 to about 1.9 times the diameter of barrel 30 with the preferred ratio of melting chamber 16 diameter to barrel 30 diameter being about 1.5 to 1. It should also be understood that the melting chamber diameter to barrel diameter ratio varies inversely with the diameter of the barrel 30, i.e., the larger the diameter of the barrel 30 the smaller the ratio of melting chamber diameter to barrel diameter; therefore, the minimum increase in diameter from barrel 30 to melting chamber 16 should be about one foot and the maximum increase in diameter from barrel 30 to melting chamber 16 should be about two feet. During initial operation or start-up, the charge 12 reaches the hearth 21 in a controlled manner and is preheated to begin the controlled formation of the semi-solid or sintered columnar mass which builds up into column 17. The width of the melting chamber 16 provides space 18 for combustion around the building column 17 to begin the melting thereof while keeping the tap hole 19 clear and preventing blockage of the burners 14 by the columnar mass 17. Thereafter, as the columnar mass 17 descends barrel 30, it exits the sintering chamber 15 as a coherent sintered column 17 with a diameter approximately equal to the inner diameter of the sintering chamber 15, enters melting chamber 16, and comes to rest on a hearth 21. The hearth 21 is preferably a multiple level hearth to promote melting of the bottom surface of the column 17 as well as melting of the circumferential surfaces while providing continued vertical support for the sintered column 17. Lateral support is maintained by the walls 22 of the sintering chamber 15 and a tubular heating space 18 is created between the walls 31 of the melting chamber 16 and the periphery of column 17. In this space 18, heat is directed from multiple burners 14 radially aligned and spaced about the interior of melting chamber 16. Burners 14 are so positioned that fuel burned therein produces a flame which contacts metal column 17 tangentially and swirls around at least 270 degrees of the periphery of column 17 symmetrically in tubular space 18 from a point directly opposite a tap hole 19 toward tapping hole 19. This symmetrical tangential application of flame melts the column of metal 17 from its outer surfaces toward its inner portions. The melted portion of columnar mass 17 is replaced by portions of column 17 which are continuously sintered in sintering chamber 15 and gravity fed from sintering chamber 15 into melting chamber 16 during operation of the furnace 10. Molten metal 20 flows down to a hearth 21 which directs the flow of metal through tap hole 19.

This embodiment is, of course, merely exemplary of the possible changes or variations. Because many varying and different embodiments may be made within the scope of the inventive concept disclosed herein and because many modifications may be made in the embodiment herein detailed in accordance with the descriptive requirements of the law, it should be generally understood that the details herein are to be interpreted as illustrative and not limiting.

What I claim as the invention is:

1. A vertical shaft furnace for melting copper without the intentional addition of fuel or fluxes to the copper and without clogging said furnace which comprises a cylindrical barrel vertically mounted upon a cylindrical melting chamber having a diameter larger than that of said barrel immediately above, said barrel being divided into a cylindrical upper preheat chamber adapted to receive and preheat a gravity charge of copper at ambient temperature, a sintering chamber located between said cylindrical upper chamber and said melting chamber and adapted to heat said preheated copper charge to a temperature only slightly below the melting temperature of copper and which is a sintering temperature for copper whereby said copper passes through said sintering chamber and a cylindrical melting chamber, including burner means for tangential and direct application of heat to said preheated copper charge, said melting chamber being adapted to receive said coherent columnar mass from said sintering chamber and continuously melt said columnar mass from the periphery thereof toward the inner portions thereof by the tangential and direct application of heat to said columnar mass and means for collecting and draining molten copper from said melting chamber as said coherent mass is melted.

2. The vertical shaft furnace of claim 1 wherein said cylindrical upper chamber comprises an upper preheat chamber and a lower sintering chamber, said upper preheat chamber having means for gravity-charging copper into said barrel during operation of said furnace and being adapted to preheat said copper to a temperature above the ambient temperature, and said lower sintering chamber having an interior wall formed of a refractory material, a plurality of openings spaced about said interior wall, downwardly inclined burner means arranged in said openings for the controlled heating of said copper to a temperature only slightly below the melting temperature of said copper whereby said copper is sintered to form a coherent columnar mass having a diameter only slightly smaller than the diameter of said cylindrical barrel at said sintering chamber.

3. The vertical shaft furnace of claim 1 wherein said cylindrical melting chamber comprises a cylindrical chamber having an interior wall formed of a refractory material, a plurality of openings spaced over at least a 270 degree portion of said interior wall, the center of which is located on the portion of said interior wall that is opposite said means for draining molten copper from said melting chamber, downwardly inclined burner means arranged in said openings for the tangential application of flame from said burners around the periphery of said columnar mass whereby said columnar mass melts from the outer portions to the inner portions thereof and a hearth to support said columnar mass, promote the rapid melting thereof and to collect molten copper to be conveyed from said melting chamber by said means for draining molten copper.

4. The vertical shaft melting furnace of claim 3 wherein said melting chamber further includes an opening in the refractory-lined inner wall of said melting chamber positioned above said means for draining said molten copper and downwardly inclined burner means arranged in said opening for the application of flame to the periphery of said columnar mass.

5. The vertical shaft melting furnace of claim 1 wherein the maximum diameter of said cylindrical melting chamber exceeds the diameter of said cylindrical barrel by a ratio of from about 1.2:1 to about 1.9:1.

6. The vertical shaft melting furnace of claim 5 wherein said melting chamber maximum diameter to cylindrical barrel diameter ratio varies inversely with the diameter of said upper cylindrical chamber.

7. The vertical shaft melting furnace of claim 6 having a melting chamber of varying diameter, said melting chamber diameter becoming larger as the hearth is approached and until the maximum melting chamber to barrel diameter is reached.

8. The vertical shaft melting furnace of claim 3 wherein said hearth comprises a multiple level hearth.

9. The method of operating a vertical shaft furnace for melting copper without the intentional addition of fuel or fluxes to the copper charge and without clogging said furnace, which furnace comprises a cylindrical barrel vertically mounted upon a cylindrical melting chamber, said barrel being divided into a cylindrical upper preheat chamber adapted to receive and preheat a gravity charge of copper at ambient temperature, a sintering chamber located between said cylindrical upper chamber and said melting chamber and adapted to heat said preheated copper charge to a temperature only slightly below the melting temperature of copper and which is a sintering temperature of copper whereby said copper forms a coherent columnar mass as said copper passes through said sintering chamber and a cylindrical melting chamber including burner means, said melting chamber being adapted to continuously receive said coherent columnar mass from said sintering chamber and continuously melt said columnar mass from the periphery thereof toward the inner portions thereof and means for collecting and draining molten copper from said melting chamber as said coherent columnar mass is melted; comprising the steps of:

(a) introducing said copper into said cylindrical barrel;
(b) preheating said copper in an upper cylindrical preheat chamber to a temperature above ambient;
(c) passing said copper through a plurality of spaced burner means for the tangential and direct application of heat to said copper whereby said columnar mass is melted from the outer portions thereof to the inner portions thereof;
(e) collecting said melting copper to form a molten metal pool; and
(f) draining said molten metal pool from said melting chamber.

10. The method of claim 9 wherein at least ten percent of said copper charge will pass through a 300 mesh screen.

11. A multiple chamber vertical shaft furnace for melting granulated metal without clogging said furnace comprising:

(a) a cylindrical upper preheating chamber with an external opening for admitting cold charge;

(b) a cylindrical middle sintering chamber with a diameter approximately equal to that of said preheating chamber and having a plurality of burners mounted in the walls thereof for sintering preheated charge into a coherent columnar mass; and (c) a cylindrical lower melting chamber having a diameter larger than that of said chamber immediately above thereby providing a tubular heating space between the walls of said melting chamber and the surface of the coherent columnar mass descending from said sintering chamber, a plurality of symetrically spaced burners mounted in the walls thereof for applying heat within said melting space and tangent to the surface of said coherent columnar mass for melting thereof, and means for discharging molten metal from said furnace.

12. The apparatus of claim 11 wherein said preheat chamber is adapted to preheat charge therein by convection heat from burners of said sintering and melting chambers.

13. The apparatus of claim 11 wherein said sintering chamber burners are adapted to direct heat radially into said charge thereby forming a coherent columnar mass with a temperature just below the liquidous temperature of said metal.

14. The apparatus of claim 11 wherein said melting chamber burners are adapted to symetrically swirl tangent heat around at least 270 degrees of the periphery of said columnar mass from a point opposite said means for discharging molten metal toward said means for discharging molten metal.

15. The apparatus of claim 11 wherein the diameter of said sintering chamber is within a range of from about 2.5 feet to about 6 feet.

16. The apparatus of claim 15 wherein said diameter is about 4.5 feet.

17. The apparatus of claim 11 wherein the diameter of said melting chamber exceeds the diameter of said chamber immediately above by a ratio of from about 1.2:1 to about 1.9:1.

18. The apparatus of claim 17 wherein said ratio is about 1.5:1.

19. The apparatus of claim 11 wherein increase in diameter from said chamber immediately above to said melting chamber is from about 1 foot to about 2 feet.

20. The apparatus of claim 11 wherein at least ten percent of said granulated metal will pass through a 300 mesh screen.

21. The apparatus of claim 11 wherein said granulated metal is a non-ferrous metal.

22. The apparatus of claim 11 wherein said metal is copper.

23. The apparatus of claim 11 wherein said granulated metal is a ferrous metal.

24. The apparatus of claim 11 wherein said melting chamber adapted to support said coherent columnar mass as said mass descends from said sintering chamber.

* * * * *